United States Patent [19]

Aono et al.

[11] 4,109,626

[45] Aug. 29, 1978

[54] FUEL SUPPLY CONTROL SYSTEM WITH FEEDBACK FUEL PIPE FOR INTERNAL COMBUSTION ENGINE

[75] Inventors: Shigeo Aono, Seki; Makoto Anzai, Yokosuka, both of Japan

[73] Assignee: Nissan Motor Company, Limited, Japan

[21] Appl. No.: 678,926

[22] Filed: Apr. 21, 1976

[30] Foreign Application Priority Data

Apr. 22, 1975 [JP] Japan ..... 50-48201

[51] Int. Cl.[2] ..... F02M 39/00; F02D 1/06; F02D 37/04

[52] U.S. Cl. ..... 123/139 AW; 123/140 MC; 123/119 EC; 261/36 A; 261/DIG. 74

[58] Field of Search ..... 123/119 EC, 139 AW, 123/119 R, 140 MC; 261/36 A, DIG. 74

[56] References Cited

U.S. PATENT DOCUMENTS

| | | | |
|---|---|---|---|
| 2,633,836 | 4/1953 | Cox | 123/119 R |
| 2,984,228 | 5/1961 | Braun et al. | 123/119 R |
| 3,741,181 | 6/1973 | Martin | 123/119 R |
| 3,837,324 | 9/1974 | Links | 123/140 MC |
| 3,842,813 | 10/1974 | Eckert | 123/119 R |
| 3,981,288 | 9/1976 | Wessel | 123/139 AW |
| 3,990,422 | 11/1976 | Watson et al. | 123/139 AW |
| 4,027,637 | 6/1977 | Aono | 123/119 EC |

*Primary Examiner*—Charles J. Myhre
*Assistant Examiner*—Parshofam S. Lall

[57] ABSTRACT

A feedback fuel pipe is provided, between a fuel reservoir and a portion of a main fuel pipe communicating with a discharging nozzle, for controlling the amount of fuel fed back to the fuel reservoir, which control is actually performed by valve means which is provided in the feedback fuel pipe and responsive to a signal representing at least one engine operating condition.

5 Claims, 7 Drawing Figures

Figure 1:
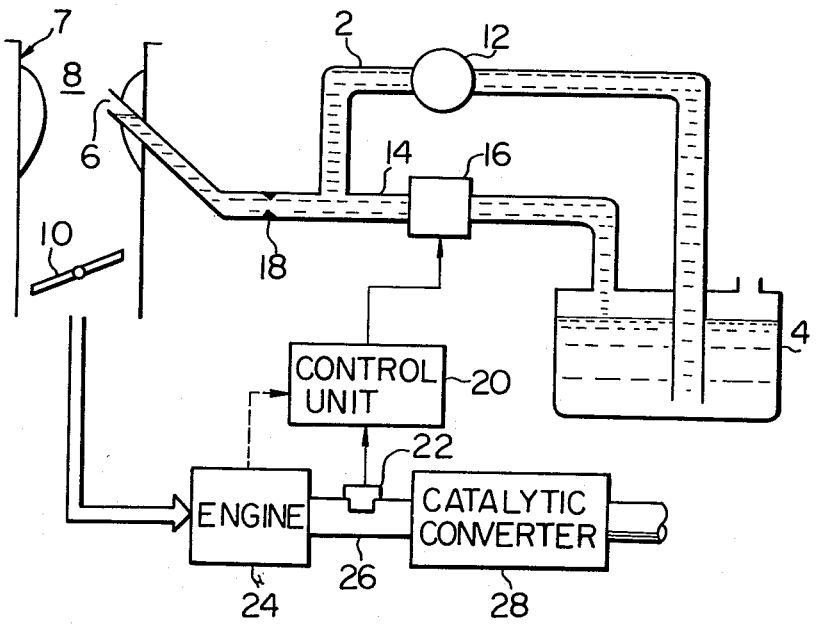

FUEL SUPPLY CONTROL SYSTEM WITH FEEDBACK FUEL PIPE FOR INTERNAL COMBUSTION ENGINE

This invention relates generally to a fuel supply control system such as a carbureting system for an internal combustion engine, and more particularly to such a system provided with a feedback fuel pipe through which part of fuel pumped from a fuel reservoir is fed back to the fuel reservoir in response to at least one selected engine operating condition, thereby to optimally control the engine operation so as to, for example, effectively reduce noxious components in exhaust gases.

In a conventional carbureting system of an internal combustion engine, an air-fuel mixture is sucked through a fuel a discharging nozzle in a venturi into an intake pipe connected to the engine due to a vacuum created in the venturi. The amount of the air-fuel mixture thus sucked is substantially determined by the height of the fuel top surface in a fuel reservoir, so that it is difficult to precisely supply the fuel into the intake pipe over a wide range of engine operating conditions. For this reason, in the conventional carbureting system, there are provided various means such as, for example, a slow discharging nozzle, and an air bleed, etc.

The conventional carbureting system, however, is complicated in structure, large in size, and expensive to manufacture due to the above-described additional or supplement means. Furthermore, in spite of the provision of the additional means, the conventional carbureting system cannot supply, over a wide range of engine operating conditions, a desired air-fuel mixture for effective reduction of noxious components (such as, $NO_x$ (nitrogen oxides), CO (carbon monoxide), and HC (hydrocarbons)) contained in the exhaust gases.

The present invention is, therefore, concerned with an improved carbureting system for an internal combustion engine, which system supplies the intake pipe with an optimal amount of fuel by controlling the amount of fuel fed back to the fuel reservoir in response to at least one selected engine operating condition.

To this end, in accordance with the present invention the carbureting system comprises: a fuel reservoir, a discharging nozzle provided in an intake pipe connected to the engine, a first fuel pipe extending between the fuel reservoir and the discharging nozzle, a fuel pump provided in the first fuel pipe, a second fuel pipe extending between the fuel reservoir and the first fuel pipe downstream of the fuel pump, and fuel flow rate control means provided in the second fuel pipe to control the amount of fuel being fed back to the fuel reservoir in response to at least one selected engine condition so as to optimally control the air-fuel ratio of the air-fuel mixture fed to the internal combustion engine.

It is therefore an object of the present invention to provide a carbureting system with a feedback fuel pipe through which part of fuel pumped from a fuel reservoir is fed back to the fuel reservoir in response to at least one selected engine operating condition.

Figure 2:
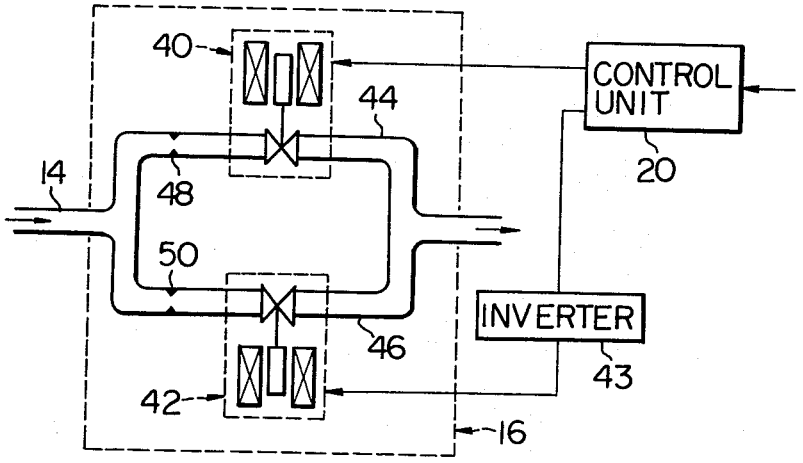
Figure 3:
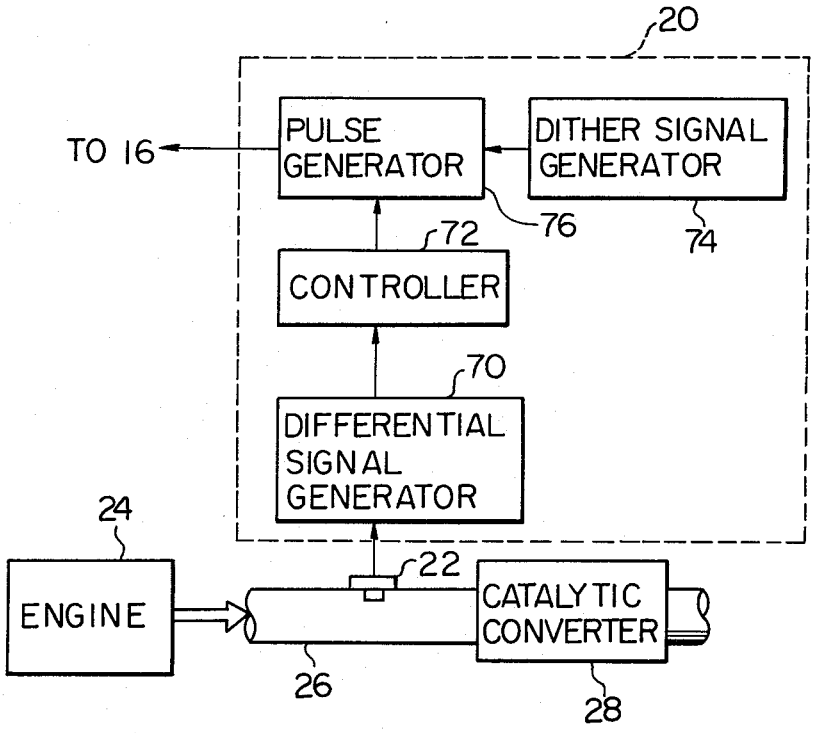
Figure 4:
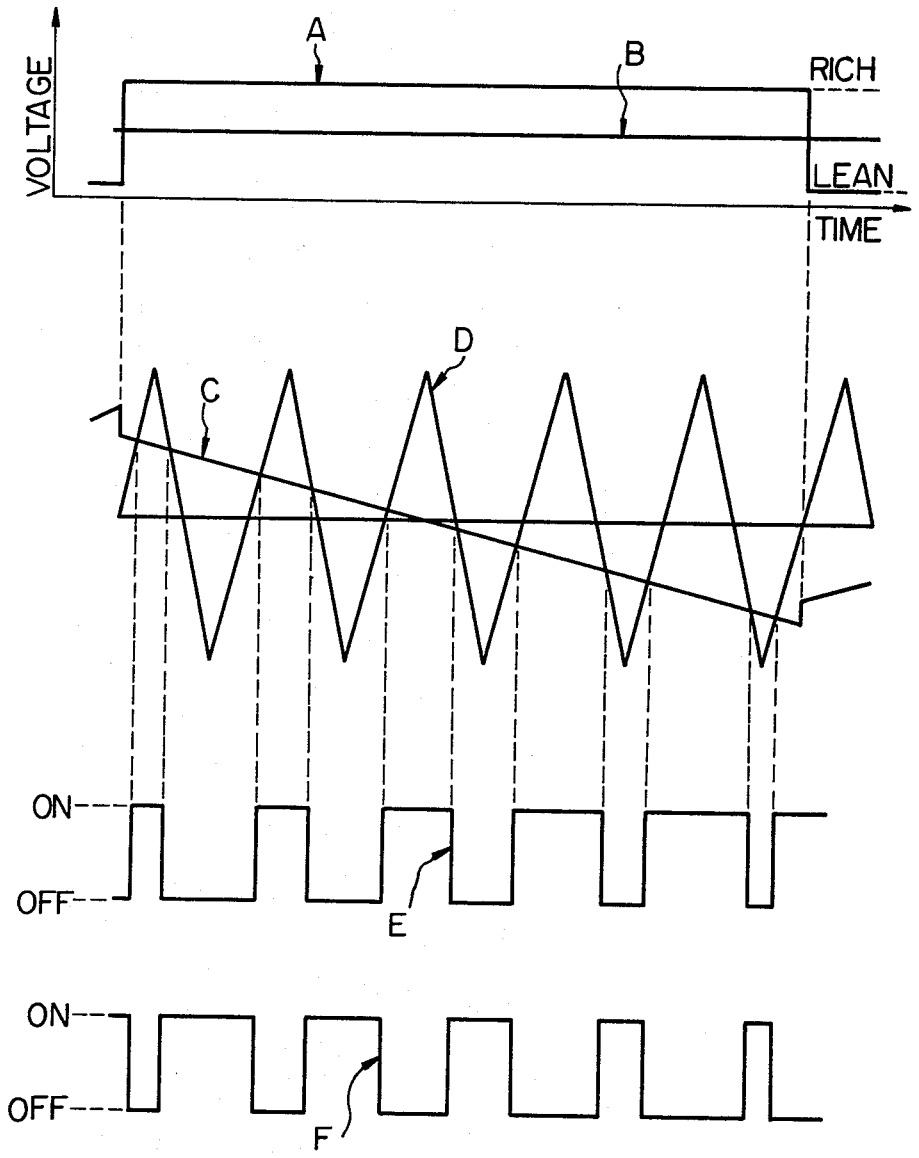
Figure 5:
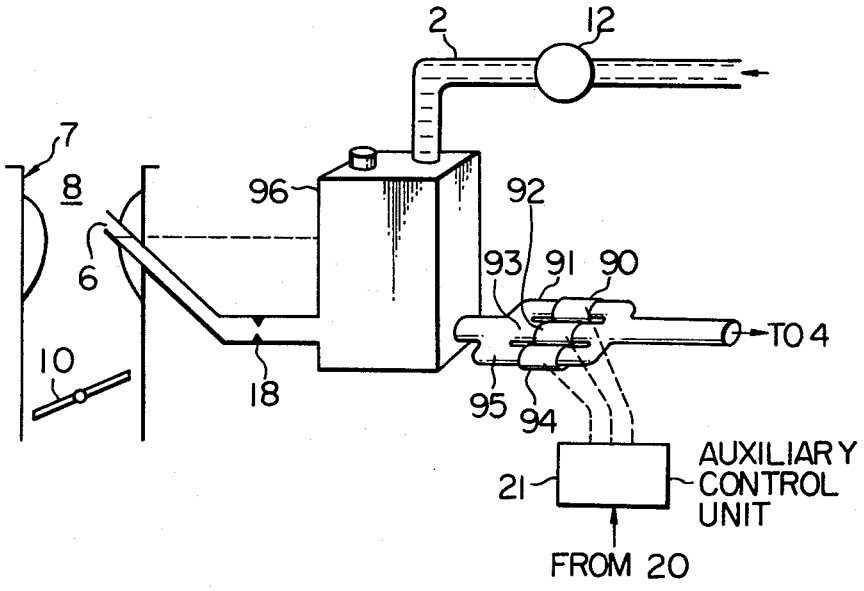
Figure 6:
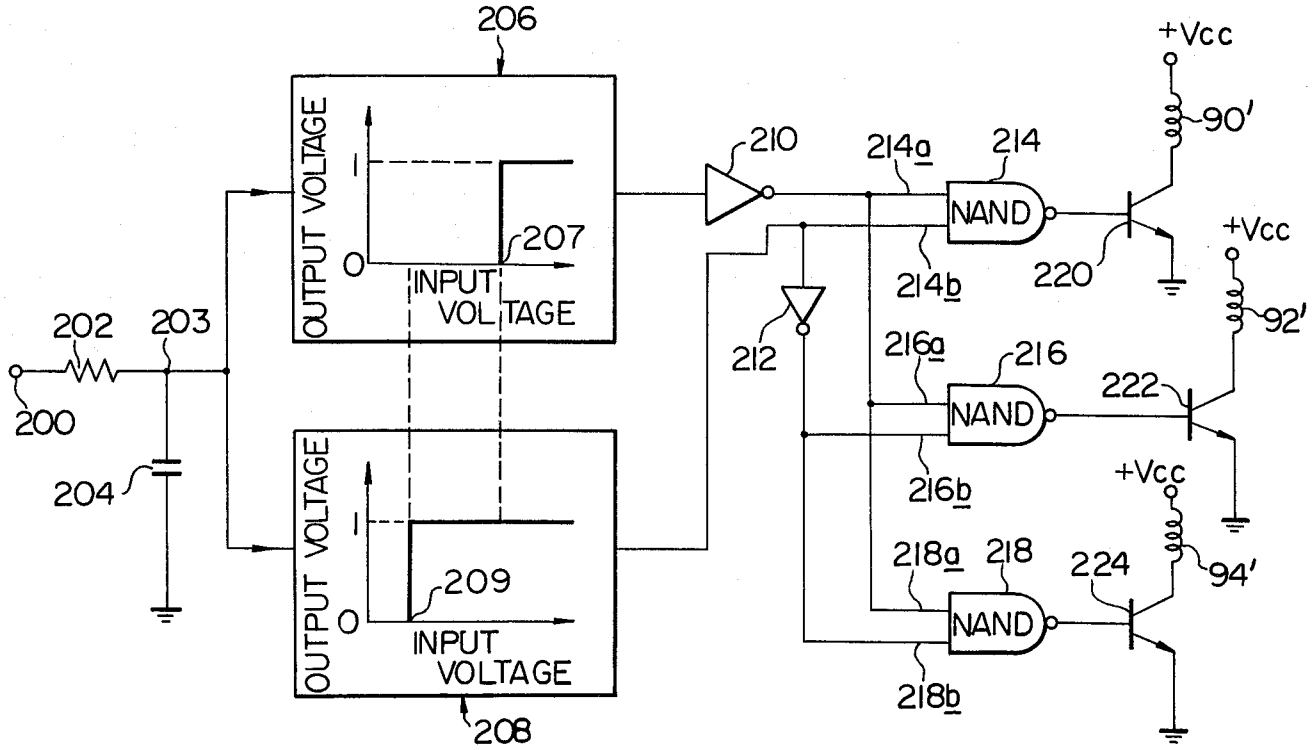

This and other objects, features and many of the attendant advantages of this invention will be appreciated more readily as the invention becomes better understood by the following detailed description, wherein like parts in each of the several figures are identified by the same reference characters, and wherein:

FIG. 1 schematically illustrates, partly in a block form, a first preferred embodiment of the present invention;

FIG. 2 schematically illustrates a detailed arrangement of a part of the first preferred embodiment shown in FIG. 1;

FIG. 3 schematically illustrates an example of an electrical closed loop air-fuel ratio control system for use with the first preferred embodiment shown in FIG. 1;

FIG. 4 shows graphs of several waveforms derived from or developed at different parts of the electrical closed loop air-fuel control system shown in FIG. 3;

FIG. 5 schematically illustrates, partly in a block form, a second preferred embodiment of the present invention; and FIG. 6 schematically illustrates an example of an auxiliary control unit of the second preferred embodiment shown in FIG. 5.

Figure 7:
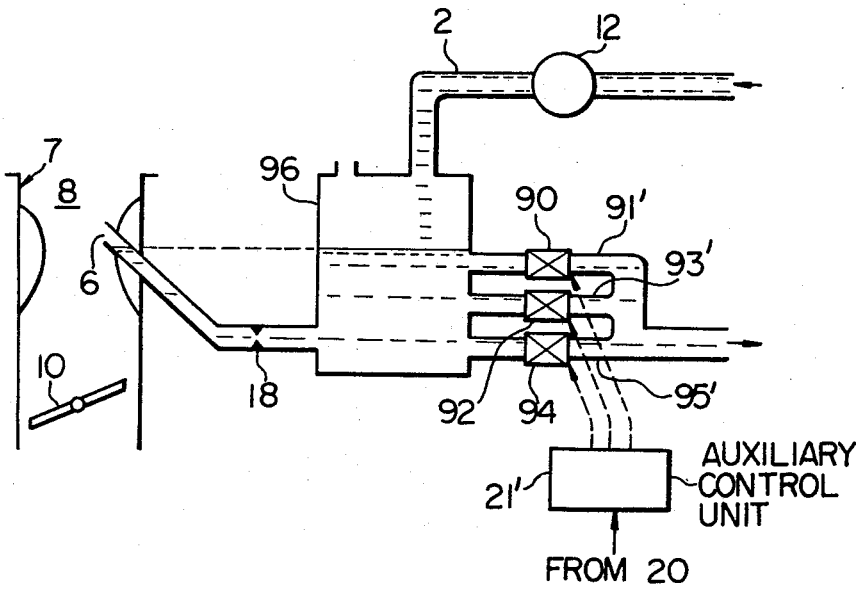

FIG. 7 schematically illustrates, partly in a block form and a perspective, a third preferred embodiment of the present invention.

Reference is now made to drawings, first to FIG. 1, in which a first preferred embodiment of the present invention is schematically illustrated with a fuel reservoir 4 (such as a fuel supply tank) and a discharging nozzle 6. The nozzle 6 protrudes into a venturi 8 upstream of a throttle valve 10 in an intake pipe 7. A fuel pump 12, which is positioned in a fuel pipe 2, pumps fuel from the fuel reservoir 4 to the discharging nozzle 6 through a suitable metering orifice 18. As shown, a feedback fuel pipe 14 is connected between the fuel reservoir 4 and a portion of the fuel pipe 2 downstream of the fuel pump 12. A fuel pressure control means or a fuel flow rate control means 16 is provided in the feedback fuel pipe 14 so as to control the amount of fuel feedback to the fuel reservoir 4, thereby to control the flow rate of fuel supplied to the discharging nozzle 6.

The fuel pressure control means 16 is preferably controlled by an electrical signal from an exhaust gas sensor 22. The exhaust gas sensor 22, such as an oxygen analyzer, is disposed in an exhaust pipe 26 for sensing the concentration of a component of the exhaust gases from an internal combustion engine 24. The exhaust gas sensor 22 generates an electrical signal representative of a sensed concentration of the component of the exhaust gases. The signal from the exhaust gas sensor 22 is supplied to a control unit 20 (which will be described in detail in connection with FIGS. 3 and 4) which computes or determines a control signal based on the signal from the exhaust gas sensor 22. The control signal indicates an optimum fuel flow rate for maximizing the efficiency of, for example, a catalytic converter 28. As the catalytic converter 28, a three-way catalytic converter is usually employed for simultaneously reducing $NO_x$ (nitrogen oxides), CO (carbon monoxide), and HC (hydrocarbons).

In the foregoing, it is to be noted that, as an alternative to the signal from the exhaust gas sensor 22, another control signal is employed which is generated based on various engine operating conditions (which are sensed by suitable sensing means provided around the engine 24): that is, (1) engine operating parameters (for example, engine speed, air intake manifold vacuum, the amount of air drawn in the opening degree of the throttle valve, and engine temperature), (2) engine running conditions (for example, cold engine start, acceleration, and deceleration) and (3) external circumstances (for example, atmospheric temperature, atmospheric pressure). In the case of employing such informations representative of engine operating conditions, when the engine is, for example, ignited at low temperature or accelerated, the fuel pressure control means 16 is responsive to such a condition to operate to supply more fuel to the nozzle 6. Whereas, at an engine operating condition such as, for example, idling or deceleration, the pressure control means 16 in turn operates so that less fuel is supplied to the nozzle 6, to increase efficiency of engine running.

The above-described two kinds of signals can be optionally employed together. According to the present embodiment, the venturi 8 can be omitted in that the fuel is supplied to the discharging nozzle 6 under pressure.

Reference is now made to FIG. 2, in which a preferred embodiment of the fuel pressure control means 16 of FIG. 1 is schematically illustrated. The signal from the control unit 20, which is in the form of pulses, is fed to an electromagnetic wave assembly 40 and also to another valve assembly 42 of a similar type through an inverter 43. The inverter 43 inverts the polarity of the control signal from the control unit 20. As shown, the two valve assemblies 40 and 42 are respectively disposed in bifurcated fuel pipes 44 and 46. The fuel pipes 44 and 46 are respectively provided with two metering orifices 48 and 50, the opening areas of which are different from each other. Therefore, provided that the valve assemblies 40 and 42 are so controlled that their opening durations are different from each other, then the amount of fuel fedback to the fuel reservoir 4 is smoothly and continuously controlled in dependence on the signal from the control unit 20, whereby the amount of fuel supplied from the nozzle to the pipe 8 is also smoothly controlled. It is understood that the amount of fuel fed back to the fuel reservoir 4 is variable within a range determined by the opening areas of the orifice 48 and 50.

In the above, each of the valve assemblies 40 and 42 is an "on" and "off" operation type, but can be substituted by an actuator of analog type.

Reference is now made to FIGS. 3 and 4, in which there are schematically illustrated an example of the control unit 20 in a block form (FIG. 3) and several waveforms developed at or derived from different elements of the arrangement shown in FIG. 3 (FIG. 4). The purpose of the control unit 20 is to electrically control the air-fuel ratio of the air-fuel mixture supplied to the engine 24. The electrical signal from the exhaust gas sensor 22 is fed to a differential signal generator 70 which generates an electric signal representative of a differential between the magnitudes of the signal from the sensor 22 and a reference signal. A portion of the waveforms of the signal from the sensor 22 is depicted by reference character A in FIG. 4. The reference signal magnitude, which is illustrated by reference character B in FIG. 4, is previously determined in due consideration the optimum air-fuel ratio of the air-fuel mixture supplied to the engine 24 for, for example, maximizing the efficiency of the catalytic converter 28 already referred to. The signal representative of the differential from the differential signal generator 70 is then fed to a controller 72 which usually includes a conventional p-i (proportional-integral) controller consisting of a suitable integrator and proportional circuit (not shown). The provision of the p-i controller, as is well known in the art, is to improve the efficiency of the electronic closed loop control system, or in other words, to facilitate a rapid transient response of the system. The output signal from the controller 72, which is depicted by reference character C in FIG. 4, is fed to the next stage, viz., a pulse generator 76 which also receives a dither signal (D in FIG. 4) from a dither signal generator 74 to generate a signal E consisting of a train of pulses as shown in FIG. 4. Each pulse of the signal E has a width which corresponds to the duration of the signal D being larger than the signal C as schematically shown in FIG. 4. The train of pulses of the signal E is then directly fed to the electromagnetic valve assembly 40 (FIG. 2), and also fed to the other valve assembly 42 through the inverter 43 wherein the signal E is inverted in its polarity as shown by reference character F in FIG. 4.

In FIG. 5, there is schematically illustrated a second preferred embodiment of the present invention, in which like parts are identified by the same reference characters as used in describing the first embodiment. As shown, another fuel reservoir 96 is provided in the fuel pipe 2 between the fuel pump 12 and the metering orifice 18, and three electromagnetic valves 90, 92, and 94 are respectively arranged in fuel branch pipes 91, 93, and 95 with substantially equal cross sectional areas, which pipes 91, 93, and 95 are connected to the reservoir 96. In operation, where the amount of fuel to be fed back to the fuel reservoir 4 is small, one of the valves 90, 92, and 94 is energized by a control signal from an auxiliary control unit 21 (a detail of which will be described in connection with FIG. 6), and on the other hand, where the amount of fuel to be fed back to the fuel reservoir 4 is medium, any two of the valves 90, 92, and 94 are selected to be energized by the control signal, and finally, where the amount of fuel to be fed back to the fuel reservoir 4 is large, all of the valves 90, 92 and 94 are energized by the control signal. Thus, the control of the amount of fuel fed back to the fuel reservoir 4 is performed in three stages in response to the control signal generated on the basis of the signal from the control unit 20.

In FIG. 6, there is exemplified a detail of the auxiliary control unit 21 of FIG. 5. An input terminal 200 is connected to the output terminal of the integrator (not shown) of the controller 72 (FIG. 3) so as to derive an integrated signal therefrom. The signal thus derived is smoothed by a smoothing circuit consisting of a resistor 202 and a capacitor 204. The smoothed signal appearing at a junction 204 is fed to two comparators 206 and 208. Prior to describing the operations of the arrangement of FIG. 6, it is assumed that the magnitude of the signal applied to the input terminal 200 increases with decrease of an air-fuel mixture ratio (or in other words, increases as the air-fuel mixture becomes richer). The comparator 206 generates a logic "1" in the case where the incoming signal is above a reference level 207. The reference level 207 indicates an upper critical value above which the actually supplied fuel to the engine 24 should be reduced. On the other hand, the comparator 208 generates a logic "0" in the case where the incoming signal is below an other reference level 209. The reference level 209 indicates a lower critical value below which an actually supplied fuel to the engine 24 should be increased. The magnitude of the incoming signal under usual engine running is between the reference levels 207 and 209.

In operation, where the magnitude of the incoming signal is below the reference level 209 (this means that the amount of actually supplied fuel to the engine 24 should be increased), each of the output signals of the comparators 206 and 208 is a logic "0". Therefore, an input terminal 214*a* of a NAND gate 214 receives a logic "1" in that the logic "0" from the comparator 206 is inverted by an inverter 210. Another input terminal 214*b* of the NAND gate 214 receives the logic "0", so that the NAND gate 214 generates a logic "1" with the result that a transistor 220 is rendered conductive the allow current to flow through a coil 90' of the valve 90. Thus, the valve 90 opens. On the other hand, an input terminal 216*a* of a NAND gate 216 receives the logic "1", and its other input terminal 216*b*, since the logic "0" from the comparator 208 is inverted by an inverter 212, receives a logic "1". As a result, the NAND gate 216 generates a logic "0", so that a transistor 222 is still in a non-conductive state. This means that current from a power source (not shown) does not flow through a coil 92' of the valve 92. Therefore, the valve 92 remains closed. Similarly, a NAND gate 218 receives the logic "1" at its two input terminals 218*a* and 218*b*, so that a transistor 224 is not rendered conductive. Consequently, current does not flow through a coil 94' of the valve 94, so that the valve 94 also remains closed.

Secondly, where the magnitude of the incoming signal is between the reference levels 207 and 209 (this means that the amount of the actually supplied fuel to the engine 24 is proper), the output signals of the comparators 206 and 208 are respectively a logic "0" and "1". Therefore, the input terminals 214*a* and 214*b* of the NAND gate 214 each receives a logic "1". This means the NAND gate 214 generates a logic "0" so that the valve 90 is closed. The input terminals 216*a* and 218*a* each receives a logic "1", and the input terminals 216*b* and 218*b* each receives a logic "0". As a result, each of the NAND gates 216 and 218 generates a logic "1", to render both transistors 222 and 224 conductive with the result that the valves 92 and 94 are opened.

Finally, where the magnitude of the incoming signal is above the reference level 207 (this means that the amount of actually supplied fuel to the engine 24 should be reduced), the output signals of the comparators 206 and 208 each generates a logic "1". As a result, each of the input terminals 214*a*, 216*a*, and 218*a* receives a logic "0", and on the other hand, the input terminal 214*b* receives a logic "1" and each of the input terminals 216*b* and 218*b* a logic "0". This means that each of the NAND gates 214, 216, and 218 generates a logic "1" respectively with result that the all valves 90, 92 and 94 are opened.

In FIG. 7, there is schematically illustrated, partly in a block form, a third preferred embodiment of the present invention. This embodiment is similar to that of FIG. 5 except that the valve 90, 92, and 94 are respectively provided in feedback pipes 91', 93', and 95', which pipes are substantially vertically spaced and connected to the fuel reservoir 96 for controlling the top surface of the fuel therein in response to a signal from an auxiliary control unit 21'. It is understood that the control unit 21' can be designed considering the FIG. 6 embodiment, so further description will be omitted for brevity.

From the foregoing, it is understood that the signal varying in its magnitude as described above selects one of the three stages to obtain a proper amount of fuel for efficient engine operation.

From the foregoing, it is understood that the fuel supply system of the present invention is able to optimally perform the fuel supply control over a wide range of engine operating conditions, though it is simplified in structure and inexpensive to manufacture.

What is claimed is:

1. A fuel supply control system for a carburetor of an internal combustion engine including; a fuel reservoir; a discharging nozzle positioned in a venturi of an intake pipe connected to the intake manifold of the engine; a first fuel pipe extending between said fuel reservoir and said discharging nozzle; wherein the improvement comprises:

(a) a fuel pump provided in said first fuel pipe for supplying fuel from said reservoir to said discharging nozzle;

(b) an orifice disposed in said first fuel pipe downstream of said fuel pump;

(c) a second fuel pipe extending between said fuel reservoir and said first fuel pipe downstream of said fuel pump and upstream of said orifice, said second fuel pipe being arranged to feedback the fuel downstream of said fuel pump to said fuel reservoir; and (d) fuel flow rate control means provided in said second fuel pipe to control the amount of fuel being fed back to said fuel reservoir in response to a signal representing at least one selected engine operating condition for regulating the height of fuel surface in said discharging nozzle in accordance with the amount of fuel fed back, the amount of fuel sucked into said intake pipe being regulated by both of the magnitude of the vacuum in said intake pipe and the height of the fuel surface in said discharging nozzle.

2. A fuel supply control system as claimed in claim 1, in which said fuel flow rate control means comprises:

a third fuel pipe provided with a first orifice therein;

a fourth fuel pipe bypassing said third fuel pipe and provided with a second orifice the opening area of which is different from that of said first orifice; and a first and a second valve provided in said third and fourth fuel pipes, respectively, and receiving said signal.

3. A fuel supply control system as claimed in claim 1, further comprising an electronic closed loop control system includes:

an exhaust gas sensor disposed in an exhaust gas pipe extending from said internal combustion engine, generating a signal representative of a sensed concentration of a component of the exhaust gases; and a control unit electrically connected to said exhaust gas sensor to receive the signal therefrom and generating the signal representing at least one selected engine operating condition based on the signal from said exhaust gas sensor.

4. A fuel supply control system as claimed in claim 1, further comprising an electronic closed loop control system which includes:

an exhaust gas sensor disposed in an exhaust gas pipe extending from said internal combustion engine, generating a signal representative of a sensed concentration of a component of the exhaust gases; and a control unit electrically connected to said exhaust gas sensor to receive the signal therefrom and to generate the signal representing at least one selected engine operating condition based on the signal from said exhaust gas sensor.

5. A fuel supply control system for a carburetor of an internal combustion engine including; a first fuel reservoir; a discharging nozzle positioned in a venturi of an intake pipe connected to the intake manifold of the engine; a first fuel pipe extending between said fuel reservoir and said discharging nozzle; wherein the improvement comprises:

(a) a fuel pump provided in said first fuel pipe for supplying fuel from said first fuel reservoir to said discharging nozzle;

(b) a second fuel reservoir provided in said first fuel pipe downstream of said fuel pump;

(c) an orifice disposed in said first fuel pipe downstream of said second fuel reservoir;

(d) a plurality of fuel pipes each vertically connected to said second fuel reservoir and provided with a plurality of valve means, the height of the highest pipe being not higher than that of said discharging nozzle;

(e) a second fuel pipe extending between said first fuel reservoir and said plurality of valve means, said second fuel pipe being arranged to feed back the fuel in the second fuel reservoir to the first fuel reservoir; and (f) a control signal generating means connected to said valve means for selectively opening the valve means in response to at least one selected engine operating condition to control the height of fuel surface in the second fuel reservoir so that the height of fuel surface in said discharging nozzle follows that of second fuel reservoir, the amount of fuel sucked into said intake pipe being regulated by both of the magnitude of the vacuum in said intake pipe and the height of the fuel surface in said discharging nozzle.

* * * * *